United States Patent [19]

Tabor

[11] 3,991,344

[45] Nov. 9, 1976

[54] SOLID-STATE DIMMER FOR DUAL HIGH PRESSURE DISCHARGE LAMPS

[75] Inventor: James B. Tabor, Wheaton, Ill.

[73] Assignee: Westinghouse Electric Corporation, Pittsburgh, Pa.

[22] Filed: Mar. 18, 1975

[21] Appl. No.: 559,463

[52] U.S. Cl. ..... 315/198; 315/247; 315/255; 315/258; 315/272; 315/297; 315/DIG. 4; 315/DIG. 7

[51] Int. Cl.[2] ..... H05B 41/16; H05B 41/392

[58] Field of Search ..... 315/194, 195, 198, 199, 315/247, 250, 254–258, 272, 283, 287, 294, 297, DIG. 4, DIG. 7

[56] References Cited

UNITED STATES PATENTS

| | | | |
|---|---|---|---|
| 3,816,794 | 6/1974 | Snyder | 315/194 |
| 3,875,458 | 4/1975 | Kappenhagen | 315/194 |
| 3,875,460 | 4/1975 | Kappenhagen | 315/194 X |
| 3,894,265 | 7/1975 | Holmes et al. | 315/194 |

*Primary Examiner*—Siegfried H. Grimm
*Attorney, Agent, or Firm*—W. D. Palmer

[57] ABSTRACT

A lighting control apparatus to provide variable intensity light from high pressure discharge lamps using two high pressure discharge lamp loads connected in series to provide more widely variable intensity of light. The outputs of two ballasts may be connected in series to feed the series connected discharge lamp load. Preferably a feedback signal proportional to load current is used to stabilize operation. In addition, circuitry is preferably provided to maintain a predetermined minimum current to prevent extinguishing of the lamps from low current and "hot restrike" circuitry is provided to limit the maximum load voltage when the lamps are extinguished.

5 Claims, 3 Drawing Figures

FIG. 1.
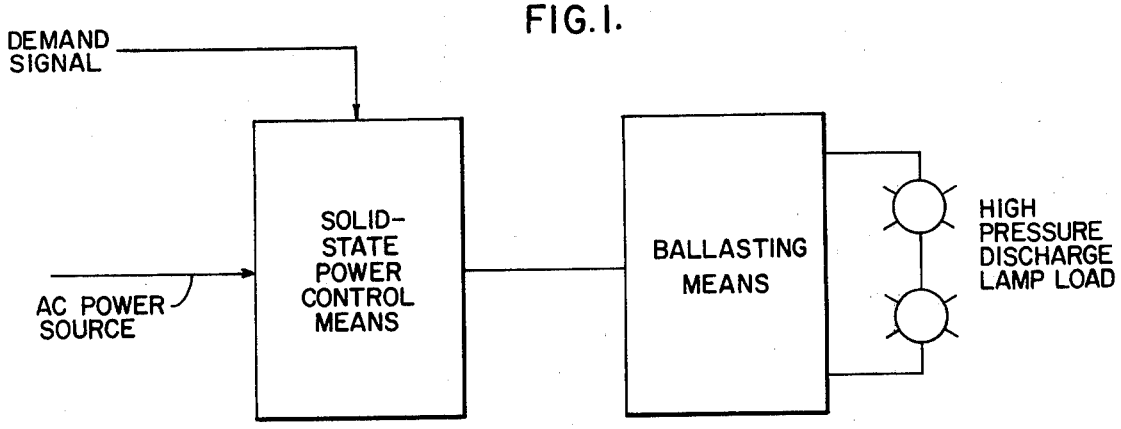
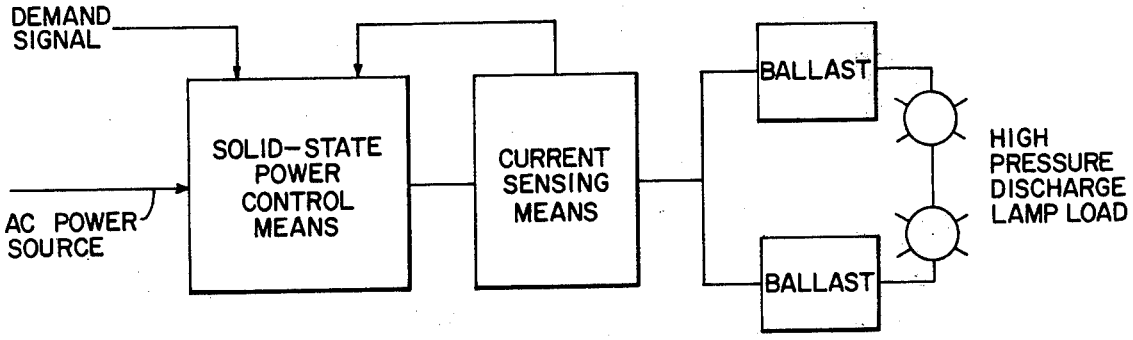
FIG. 2.

ISOLATION TRANSFORMER
DEMAND SIGNAL
277V AC P.S.

SOLID-STATE DIMMER FOR DUAL HIGH PRESSURE DISCHARGE LAMPS

CROSS-REFERENCE TO RELATED APPLICATION

In copending application Ser. No. 558,109, filed Mar. 13, 1975 by J. C. Engel and owned by the same assignee, is described a dimmer for high pressure discharge lamps utilizing a variable duty-cycle photocoupler. This copending application provides isolation of the low voltage demand circuitry from the higher voltage lamp circuitry by means of an LED and a photosensitive resistor and avoids the nonlinearity problems normally associated with such photocouplers by using an ON/OFF duty cycle rather than proportional signals.

BACKGROUND OF THE INVENTION

This invention relates to lighting systems which control the level of illumination of one or more lamps, such as in a stage lighting system or in other lighting applications where varying intensities of lighting is desired. In particular, this invention relates to controlling the intensity of light from high pressure lamps rather than incandescent lamps or low pressure discharge (fluorescent) lamps.

Solid-state electronic dimmers have been used to control the level of illumination from incandescent lamps for a number of years. While some of these solid-state dimmers are of an open loop type, others sense load voltage and feedback a signal proportional to load voltage (to stabilize the lamp control system and to compensate for line voltage variations). Some dimmers also sense load current in order to prevent damage to the dimmer from overcurrent due to the connection of excessive wattage of incandescent lamps to the dimmer output or due to inadvertent short circuits. U.S. Pat. No. 3,821,601 issued to Kappenhagen et al. on June 28, 1974, describes an incandescent dimmer utilizing voltage feedback and overcurrent protection.

Utilizing high pressure discharge lamps with a dimmer not specifically designed for such lamps is generally unsatisfactory. Solid-state dimmers generally control the portions of each half cycle during which voltage from an AC voltage source is supplied to a load. The high pressure discharge lamps tend to extinguish when the voltage remains off for a significant portion of a half cycle and the normal ballasting used will typically not reestablish the arc. Further, the arc voltage is not proportional to lamp intensity and voltage feedback does not provide a satisfactory method of stabilizing operation.

SUMMARY OF THE INVENTION

It has been found that two series connected high pressure discharge lamps can be operated from a solid-state dimmer by using twice the single lamp voltage such as is conveniently provided by using two ballasts with series connected outputs. It has been found that the voltage across the pair of lamps (which is double the normal voltage output of a single ballast) tends to appear predominantly across one of the lamps causing that lamp to start to conduct. Once one of the lamps starts to conduct, the voltage across that lamp drops to a low value and the remaining lamp sees a voltage which approaches twice the normal ballast output voltage which high voltage causes the second lamp to begin to conduct. Thus the problem to the high pressure discharge lamps failing to resume conduction after the voltage is reapplied (after having been off for a significant portion of a half cycle) is avoided.

Preferably a current sensing means is connected in series with the load and a current feedback signal is used to stabilize the operation of the apparatus. The use of the current feedback signal minimizes variations in lighting intensity which would normally be caused by line voltage variations and also reduces the effect of minor variations of values of components within the lighting control apparatus.

In addition, circuitry is also preferably provided to assure that at least a minimum current flows in the load (to prevent extinguishing of the lamps when the intensity demand is quickly lowered) and additional circuitry is provided to limit the maximum load voltage (especially if the lamps are inadvertently extinguished).

BRIEF DESCRIPTION OF THE DRAWINGS

The invention can be best understood by reference to the following drawings, in which:

FIG. 1 is a block diagram showing the basic arrangement of the elements of the invention, including the ballast-lamp relationship;

FIG. 2 is a block diagram illustrating the use of a current sensing means; and

DESCRIPTION OF THE PREFERRED EMBODIMENT

Figure 3:
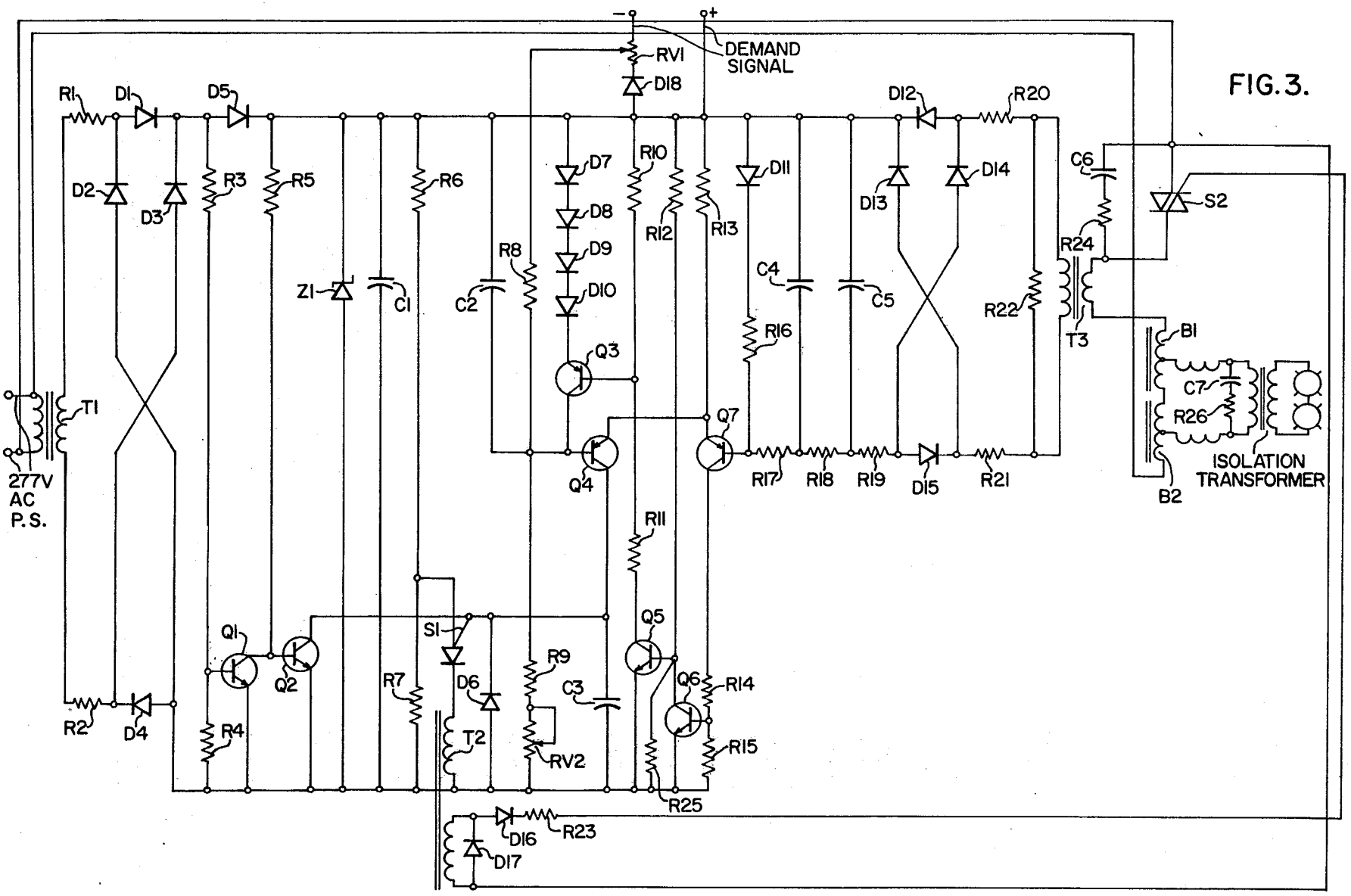
FIG. 3 is a detailed circuit diagram of a preferred configuration.

The block diagram of FIG. 1 shows the basic elements of the lighting control apparatus to provide variable intensity light from high pressure lamps in response to an electrical demand signal. The apparatus controls the portion of each half cycle during which voltage from an AC voltage source is supplied to a load comprising two series-connected high-pressure-discharge lamps. The solid-state power control means has a signal input which is adapted to be connected to an externally generated demand signal. The solid-state power control means also has a power input and a power output, with the power input being adapted to be connected to a source of AC power. Typically the solid-state power means uses either a triac or back-to-back SCRs to switch the power being supplied to the load.

The ballasting means gives twice the normal voltage output of a single lamp ballast and has an input and an output. The input of the ballasting means is connected to the output of the power control means. A convenient arrangement for ballasting means is the use of two standard 120 volt ballasts with their inputs connected in series when used with a nominal 277 volt AC power source (if the 120 volt ballasts are used in conjunction with a 120 volt power source, the inputs of the ballasting means would be connected parallel). The two high pressure discharge lamp loads are connected in series across the serial connected outputs of the two ballasts (with 120 volt ballasts, some type of transformer such as an isolation transformer or a transformer ballast is required to effectively serially connect the outputs of ballasts).

Various types of high pressure discharge lamps can be used with this invention. Typically, high pressure mercury vapor lamps are used, but other high pressure metal vapor lamps can also be used including metal halide types and high pressure sodium lamps. Circuit modifications appropriate for such lamps, such as starting circuits for high pressure sodium lamps, are well known in the art.

FIG. 2 is a block diagram illustrating the use of a current sensing means to provide a regulated dimmer. The use of a current feedback provides for more stable operation and less sensitivity to variations such as changes in line voltage or in the value of circuitry components. The current sensing means is connected in series with the load and with the solid-state power control means and develops a current feedback signal which is connected to a feedback input of the power control means. Various types of current sensing means can be used, including a current transformer, and the current sensing means can be connected at various points in the circuit, including, for example, either between the AC power source and the solid-state power control means, or between the solid-state power control means and the ballasting means.

Preferably the apparatus also contains circuitry means to provide at least a predetermined minimum current (typically 25–35 percent of rated lamp current which will provide approximately 5 percent of rated lamp output). This provides both an accurate minimum current under normal operation (discharge lamps generally will not operate properly at very low current) and also to avoid extinguishing of the lamp when the demand level is rapidly reduced. A rapid reduction in demand signal, without a minimum current circuit would rapidly reduce the current below that necessary for operation of the lamp (a high pressure discharge lamp can only be dimmed relatively slowly). With such a minimum current circuit, the minimum current is maintained even though the demand is reduced rapidly and the lamp will continue to operate while dimming slowly until the lower demand level is reached.

With current feedback operation it is desirable to avoid the possibility of subjecting the lamp to excessive voltage. This could occur as sometimes when hot lamps have been inadvertently extinguished they cannot be restarted. Under such conditions there is no load current and the current feedback circuitry attempts to compensate by calling for more current to be fed to the load which cause a high voltage across the lamp. Hot-restrike circuitry is therefore preferably included to limit the maximum load voltage when there is no load current.

Under some conditions it is also desirable to provide isolation transformers as part of the discharge lamp loads. The isolation transformers allow one side of both of the discharge lamps to be at ground potential. When isolation transformers are used, the primaries are connected in series between the outputs of the ballasting means and each of the discharge lamps is individually connected to an isolation transformer secondary.

FIG. 3 is a schematic showing a preferred embodiment for use with a 277 volt AC source and two high pressure mercury lamps. Table I is a component listing for this circuit:

TABLE I

| Reference Identification | Component Value |
|---|---|
| D1 through D17 | 1N645A |
| R1, R2, R20, R21, R24 | 300 ohm at ½ watt |
| R3 through R7, R10, R11, R12, R17, R25 | 100K at ½ watt |
| R8, R9, R18 | 22K at ½ watt |
| R13 | 2.2K at ½ watt |
| R14 | 4.3K at ½ watt |
| R16 | 15K at ½ watt |
| R22 | 150 ohm at ½ watt |
| R23 | 47 ohm at ½ watt |
| R26 | 100 ohm at ½ watt |
| C1 | 125 mfd at 50 volt |
| C2 | 35 mfd at 50 volt |
| C3, C5 | .22 mfd at 50 volt |
| C4 | 1.0 mfd at 50 volt |
| C6 | 0.1 mfd at 600 volt |
| C7 | 0.1 mfd at 1000 volt |
| Q1, Q2, Q5, Q6 | 2N4123 |
| S1 | 2N6027 |
| S2 | 2N5446 |
| Z1 | 1N970B |
| RV1 | 100k Potentiometer |
| RV2 | 1Meg Potentiometer |
| T1 | 277/24 volt; Johnson Electric J-6932 |
| T2 | Sprague 11Z2000 |
| T3 | 12:1000 current transformer |

The ballasts used in conjunction with FIG. 3 are standard high-reactance autotransformer ballasts. While a single special ballast could be used to provide the double normal ballast voltage, cost reduction is gained by the use of standard commercially available ballasts.

The transformer T1 with diodes D1, D2, D3, D4 give a low voltage supply from the 277 volt line. This is filtered and zenered with Z1 and C1. C3 is a ramp generator, which is reset at each line voltage zero by reset circuit Q1, Q2. When the voltage on C3 reaches the breakover voltage, determined by the unijunction transistor S1, the pulse transformer T2 is energized and drives the triac S2. The ramp or charge time of C3 is determined by the differential amplifier Q4, Q5, Q6, Q7. The current transformer, T3, with diodes D12, D13, D14, D15 together with the filter R16, R17, R18, R19, C4, C5, D11, provide a DC voltage across the D11 and R16 which is proportional to the current in T3 and thus is proportional to the load current. Since Q7 and Q4 have a common emitter resistor R13, any increase in DC across D11 and R16 decreases the collector current of Q4. An external DC demand signal is impressed on D18 and RV1 to control the collector current of Q4. Thus any error in the load current acts through T3 to cause a change in the base drive to Q7 which causes the opposite change in Q4 collector current and a consequent change in the charge rate of C3 and changes the timing of the firing pulse which T2 transmits to the triac S2. This change compensates for the error in current, thus regulating the lamp current.

The diode string D7, D8, D9, D10 together with Q3, Q5, Q6 operates as a starting circuit for "hot-restrike" operation. This special starting circuit operates when the lamp is completely extinguished (as opposed to off for a fraction of a cycle) to avoid impressing the full 277 volt line on the two autotransformer primaries (each primary is normally 120 volts and thus the series rating would be only 240 volts). Applying the 277 volts to the two autotransformers which together have a nominal rating of 240 volts would result in an overvoltage of about 15 percent. Assuming that the lamps are hot, but have been extinguished and the dimmer is energized, the lamp current is zero and the voltage across D11 and R16 is zero and Q7 will have no collector current. Then Q6 is off and Q5 is on (receiving base drive through R12). With Q5 on, the voltage across R10 is impressed on D7, D8, D9, D10 and on the base of Q3. This combination acts effectively as a Zener diode and limits the current through R13 and consequently limits the collector current of Q7 (regardless of the magnitude of the demand signal on D18 and RV1). The resistors R10 and R11 are chosen such that the collector current of Q4 causes the firing of triac S2 to occur just past the peak of the 277 volt line voltage. Once the lamps start, a voltage appears across D11 and R16 turning on Q7 and the Q7 collector current turns on Q6 which stops the base drive to Q5 and Q5 turns off. With Q3 off, Q4 can respond to the value of the demand signal impressed across D18 and RV1 and the solid-state power control circuitry can regulate lamp current in response to the demand signal.

The purpose of R9 and RV2 is to set the minimum lamp current for the minimum light level when the demand signal is zero and also for maintaining enough current to keep the lamp lit when the demand is rapidly decreased. Typically this current is 25 to 35 percent of the arc current at full rated lamp watts. At steady state this current will provide a light output from each of the lamps of about 5 percent of the rated light output.

The capacitor C7 provides some resonance with the two 120 volt high reactance autotransformer ballasts B1, B2 and this resonance provides a slightly higher voltage for initiating conduction of the high pressure discharge lamps.

The circuit of FIG. 3 can, of course, be modified to use two SCRs in place of triac S2 with an appropriate change in the pulse transformer T2.

I claim:

1. A lighting control apparatus to provide variable intensity light from high pressure discharge lamps, said apparatus being responsive to an externally generated electrical demand signal to control power supplied from an AC voltge source to a load comprising two series-connected high pressure discharge lamp loads, said apparatus comprising:

a. solid-state power control means having a signal input, a power input, and a power output, said signal input adapted to have said demand signal applied thereto, said power input adapted to be connected to said source of AC voltage, said solid-state power control means being responsive to said demand signal to control the portion of each half cycle during which voltage from said AC voltage source is applied to said power output thereof;

b. ballasting means having an input and an output, said ballasting means input being connected to said power control means power output; and c. two high pressure discharge lamp loads, said two discharge lamp loads being connected in series to the output of said ballasting means.

2. The apparatus of claim 1, wherein a current sensing means is connected in series with said solid-state power control means for developing a current feedback signal, and wherein said solid-state power control means has a feedback input, and said current feedback signal is connected to said feedback input of said solid-state power control means.

3. The apparatus of claim 2, wherein said solid-state power control means contains circuitry means to provide at least a predetermined minimum current to said load and hot restrike circuitry means to limit the maximum load voltage when there is no load current.

4. The apparatus of claim 1, wherein said ballasting means consists of two ballasts with serially connected outputs, each said ballast having a nominal voltage rating of about 120 volts, and said apparatus is adapted to be connected to an AC power source of about 277 volts.

5. The apparatus of claim 4, wherein said discharge lamp loads include an isolation transformer having a primary and a secondary, the primary of said isolation transformer connected across said serially connected outputs of said two ballasts, and said serially connected discharge lamps are connected across the secondary of said isolation transformer.

* * * * *